US007081031B2

(12) United States Patent
Hirano et al.

(10) Patent No.: US 7,081,031 B2
(45) Date of Patent: Jul. 25, 2006

(54) METHOD OF PRODUCING PLASMA DISPLAY DEVICES

(75) Inventors: Shigeo Hirano, Shiga (JP); Hiroshi Watanabe, Kyoto (JP); Toshio Imai, Osaka (JP); Akira Mizuno, Osaka (JP); Yutaka Tani, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 152 days.

(21) Appl. No.: 10/276,267

(22) PCT Filed: Apr. 26, 2002

(86) PCT No.: PCT/JP02/04296

§ 371 (c)(1),
(2), (4) Date: May 5, 2003

(87) PCT Pub. No.: WO02/091339

PCT Pub. Date: Nov. 14, 2002

(65) Prior Publication Data

US 2003/0171058 A1 Sep. 11, 2003

(30) Foreign Application Priority Data

May 8, 2001 (JP) ..... 2001-137014

(51) Int. Cl.

| | |
|---|---|
| ***H01J 9/46*** | (2006.01) |
| ***H01J 9/20*** | (2006.01) |
| ***H01J 9/00*** | (2006.01) |
| ***H05B 33/10*** | (2006.01) |

(52) U.S. Cl. ..... 445/66; 445/24; 445/25

(58) Field of Classification Search ..... 445/24, 445/25, 11, 12, 13, 23, 58, 66
See application file for complete search history.

(56) References Cited

U.S. PATENT DOCUMENTS

| | | | | |
|---|---|---|---|---|
| 4,472,461 | A * | 9/1984 | Johnson | 427/208.6 |
| 5,684,361 | A * | 11/1997 | Seki | 313/582 |
| 5,697,825 | A * | 12/1997 | Dynka et al. | 445/25 |
| 5,852,484 | A * | 12/1998 | Inoue et al. | 349/86 |
| 6,247,986 | B1 * | 6/2001 | Chiu et al. | 445/24 |
| 6,251,208 | B1 * | 6/2001 | Serizawa et al. | 156/232 |
| 6,450,850 | B1 * | 9/2002 | Nunomura | 445/24 |
| 6,568,978 | B1 * | 5/2003 | Kataoka et al. | 445/24 |

FOREIGN PATENT DOCUMENTS

| | | |
|---|---|---|
| JP | 1-133238 | 5/1989 |
| JP | 6-177179 | 6/1994 |
| JP | 10-254372 | 9/1998 |
| JP | 2001-35145 | 2/2001 |

* cited by examiner

*Primary Examiner*—Nimeshkumar D. Patel
*Assistant Examiner*—Elizabeth Rielley
(74) *Attorney, Agent, or Firm*—Wenderoth, Lind & Ponack, L.L.P.

(57) ABSTRACT

A method for manufacturing a plasma display apparatus includes bonding a panel to a sustaining board (chassis) with a sufficient bonding area. In a process of bonding the panel to the chassis, the panel is supported on the sustaining board (chassis) via a heat conducting sheet. Then the panel and the chassis are sandwiched between resilient pressuring boards, which are larger than the panel and the chassis. After that, a predetermined pressure is applied from at least one of the pressuring boards, thereby bonding the panel to the chassis via a heat conducting sheet.

7 Claims, 6 Drawing Sheets

METHOD OF PRODUCING PLASMA DISPLAY DEVICES

FIELD OF THE INVENTION

The present invention relates to a method for manufacturing a plasma display apparatus, which is a thin, light and large display.

BACKGROUND OF THE INVENTION

Recently, a plasma display apparatus has received attention as a display panel having good visibility or a thin display device, and have been developed for high resolution and larger screen.

Plasma display apparatuses are classified into two driving systems, i.e., an AC type and a DC type, and classified into two electric discharge systems, i.e., a surface discharge type and an opposed discharge type. The AC and surface discharge type plasma display apparatus has become mainstream, because of high resolution, a large display and easy manufacturing.

FIG. 8 shows an example of the plasma display apparatus. As shown in FIG. 8, a casing for accommodating panel 1 is formed of front frame 2 and metal back cover 3. Front cover 4 made of glass and the like, which is used as an optical filter or a protector, is disposed on an opening of front frame 2. Silver is deposited on front cover 4 for suppressing unwanted radiation of electromagnetic waves. A plurality of venting holes 5 for venting heat, which is generated from panel 1, are formed on back cover 3. Panel 1 adheres to chassis (sustaining board) 6 via heat conducting sheet 7, where chassis 6 made of aluminum and the like is used as a sustaining board and a radiating board. Heat conducting sheet 7 is made of a double-sided adhesive sheet, e.g., acrylic, urethane or silicon, or has adhesive layers on both sides. A plurality of circuit blocks 8, which drive panel 1 for display, are disposed at a rear surface of chassis 6. Heat conducting sheet 7 has a function of transmitting heat generated from panel 1 to chassis 6 efficiently, and chassis 6 having a function of a radiating board radiates the heat. Circuit blocks 8 include electric circuits for driving and controlling panel 1 for display, and are connected electrically with lead-wires of electrodes routed at margins of panel 1, by using a plurality of flexible wiring boards (not shown), which extend over four margins of chassis 6.

Bosses 9, which are produced in one piece by die-casting or are produced by fixing pins, protrude from a rear surface of chassis 6 and are used for setting circuit blocks 8 or fixing back cover 3.

In the plasma display apparatus discussed above, panel 1 is required to be bonded entirely to chassis 6 so as to not separate from each other while being transported or operated, and so as to transmit transmitting heat generated from panel 1 to chassis 6 efficiently.

The conventional process of bonding panel 1 to chassis (sustaining board) 6 via heat conducting sheet 7 including an adhesive layer is performed by handwork for preventing panel 1 from breaking, because panel 1 is made of glass. As a result, a bonding area between heat conducting sheet 7 and panel 1 or chassis 6 becomes small, and unevenness of bonding tends to appear on panel 1. In other words, panel 1 does not adhere to chassis 6 firmly, so that heat generated from panel 1 can not be transmitted to chassis 6 efficiently. Moreover, mechanical strength of the plasma display apparatus decreases, because panel 1 and chassis 6 are not integrated.

The present invention addresses the problems discussed above, and aims to provide a plasma display apparatus which has efficient radiating-heat characteristics and high strength by securing a sufficient bonding area between a panel and a sustaining board.

SUMMARY OF THE INVENTION

A method for manufacturing a plasma display apparatus of the present invention addresses the problems discussed above, and includes bonding a panel having a plurality of discharging cells to a metal sustaining board disposed at a back of the panel via an adhesive sheet. The panel includes a pair of opposing substrates having a discharging space therebetween with at least a front substrate being transparent.

The method for manufacturing the plasma display apparatus also comprises piling (mounting) the sustaining board on the panel via the adhesive sheet, sandwiching the panel and the sustaining board between a resilient panel-side pressuring board, which is larger than the panel, and a resilient sustaining-board-side pressuring board, which is larger than the sustaining board, and applying pressure to the panel and the sustaining board from above the panel-side pressuring board or the sustaining-board-side pressuring board.

In the method of the present invention, pressure can be applied to a bonding area entirely using the resilient pressuring boards, so that uniform bonding can be achieved. In addition, the pressuring boards absorb local stress, thus preventing the panel from being destroyed, because the pressuring boards have resilient characteristics.

Because the adhesive sheet has heat conducting and resilient characteristics, conduction of heat from the bonded panel to the sustaining board used as a radiating board improves. Besides, in the case of applying pressure and bonding, the adhesive sheet also absorbs local stress.

The adhesive sheet is preferably formed of a porous insulating sheet having adhesive layers on both sides. In the case of applying pressure and bonding, resilience can be achieved because of its porous characteristic. In addition, air bubbles are expelled sufficiently, so that the heat conducting characteristic is not lost.

The pressuring board has electrical conductivity. As a result, static electricity, which is generated while applying pressure and bonding, is removed, and circuit elements bonded on the panel are protected from the influence of static electricity and are prevented from being destroyed.

A surface, which faces the sustaining board, of the sustaining-board-side pressuring board is molded corresponding to a shape of the sustaining board. Accordingly, the sustaining-board-side pressuring board can be fixed to a concave-convex shaped sustaining board, thereby applying pressure to the sustaining board entirely and uniformly.

The panel-side pressuring board has a three-layered structure formed by laminating sequentially a first buffer, a second buffer and a resin sheet for preventing electrification. The first buffer is formed at a surface, which comes into contact with the panel, of the panel-side pressuring board and has a large compressive elasticity modulus, and the second buffer is harder than the first buffer. Using the structure mentioned above, in the case of applying pressure and bonding, the first buffer, which comes into contact with the panel, can absorb local stress generated by deforming of the panel. In addition, pressure is applied to the panel entirely, because the second buffer has a large hardness. The resin sheet prevents contact electrification between a press stand and the panel-side pressuring board, so that durability improves.

In the case of applying pressure, pressure is applied gradually, then kept, and finally released, so that the panel is prevented from being destroyed, and uniform bonding can be achieved.

DETAILED DESCRIPTION OF THE PREFERRED EMBODIMENT

An exemplary embodiment of the present invention is described hereinafter with reference to FIGS. 1 to 7.

Figure 1:
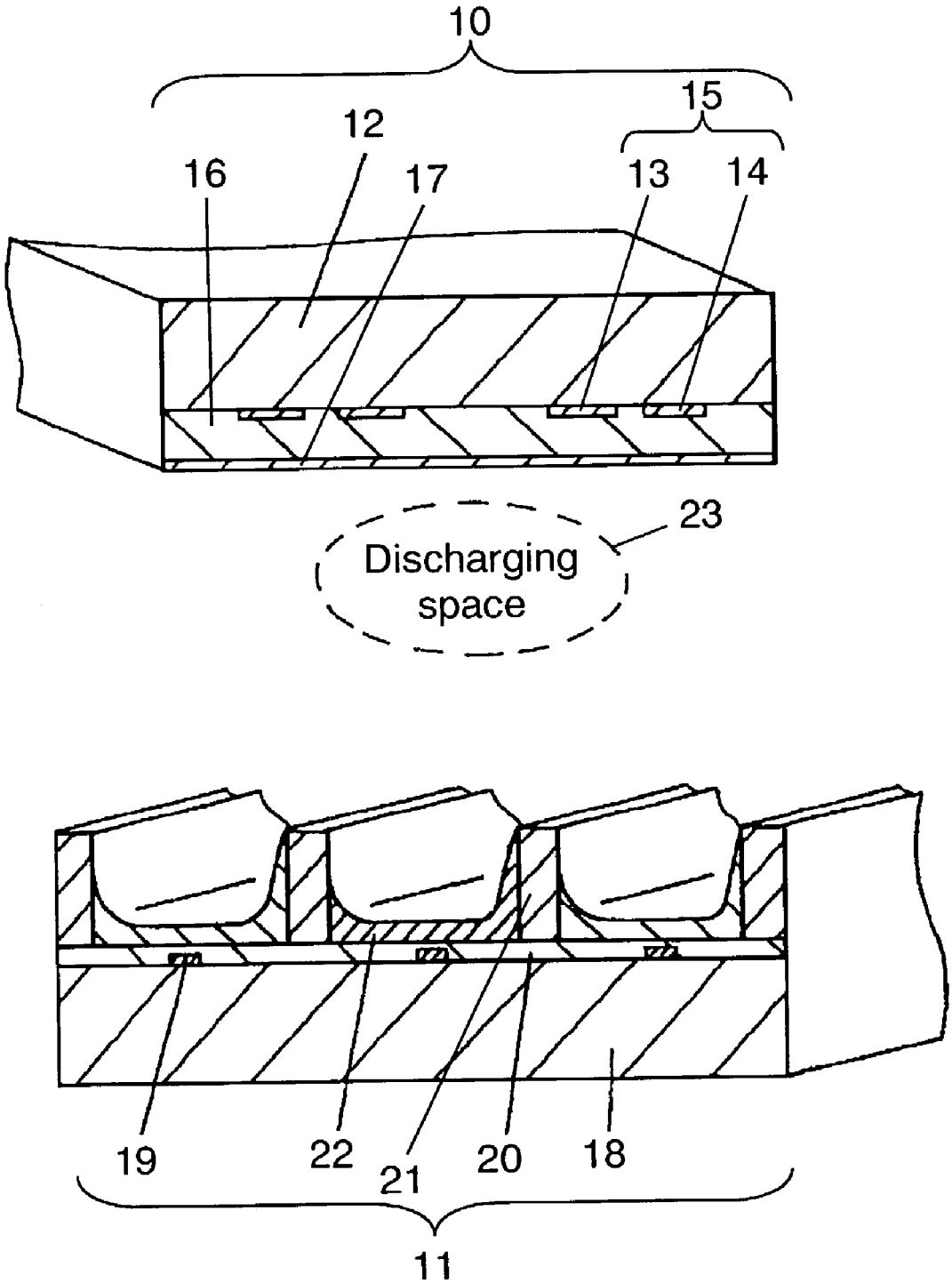
FIG. 1 is a perspective sectional view showing a panel structure of an AC-surface-discharge type plasma display apparatus.

FIG. 1 is a perspective sectional view showing a panel structure of a plasma display apparatus. The panel is formed of front panel portion 10 and rear panel portion 11. Front panel portion 10 is formed of front substrate 12, display electrode 15, dielectric layer 16 and protective film 17. Front substrate 12 is made of transparent substrate such as glass. Display electrodes 15 are formed of a plurality of scanning electrodes 13 and a plurality of sustain electrodes 14, which are formed on front substrate 12, where scanning electrode 13 and sustain electrode 14 form a pair and striped pattern. Dielectric layer 16 is formed on front substrate 12 with display electrodes 15 covered. Protective film 17 is formed on dielectric layer 16.

Rear panel portion 11 opposing to front panel 10 is formed of rear substrate 18, address electrode 19, overcoat layer 20, barrier rib 21 and phosphor layer 22. A plurality of striped address electrodes 19 are formed on rear substrate 18, and are arranged to cross display electrodes 15 formed on front substrate 12. Overcoat layer 20 is formed on rear substrate 18 so as to cover address electrodes 19. A plurality of barrier ribs 21 are disposed between adjacent address electrodes 19 on overcoat layer 20, and parallel to address electrodes 19. Phosphor layer 22 is formed on both sides of barrier ribs 21 on the surface of overcoat layer 20.

Front panel portion 10 and rear panel portion 11 face each other, and have small discharging space 23 therebetween, and display electrodes 15 on front panel portion 10 are arranged to cross address electrodes 19 on rear panel portion 11 at approximately right angles. The circumference of front panel portion 10 and rear panel portion 11 are sealed, and at least one of helium, neon, argon and xenon is injected into discharging space 23 and used as discharging gas. Discharging space 23 is divided into a plurality of cells by barrier ribs 21, namely the plurality of discharging cells are formed at crossing points of display electrodes 15 and address electrodes 19. Phosphor layer 22, which shows red, green or blue, is disposed at each of the discharging cells.

Figure 2:
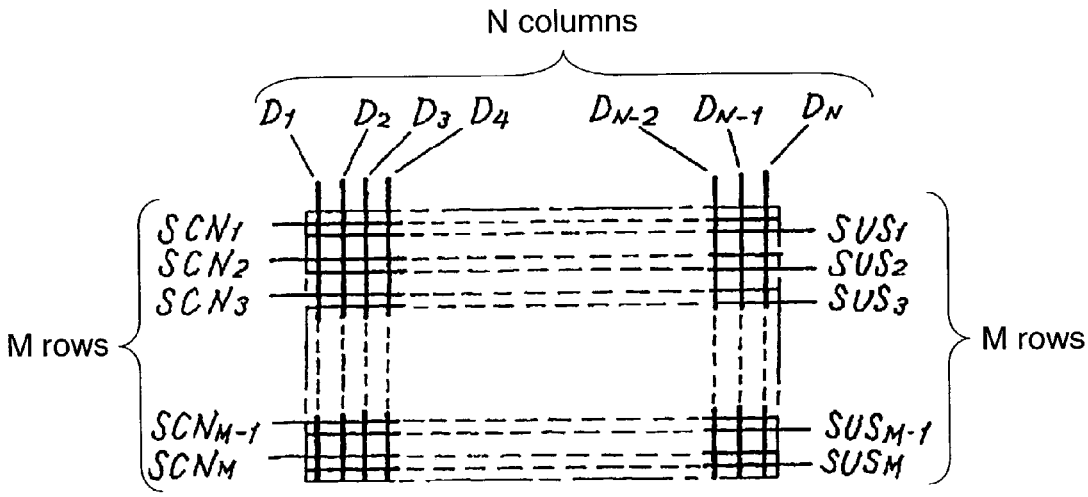
FIG. 2 shows electrode arrays of a panel of the AC-surface-discharge type plasma display apparatus.

FIG. 2 shows electrode arrays of the panel of the plasma display apparatus. As shown in FIG. 2, scanning electrodes 13 and sustain electrodes 14, which form display electrodes 15, and address electrodes 19 form a matrix with an M by N array. M-rows scanning electrodes SCN1 through SCNM and sustain electrodes SUS1 through SUSM are arrayed in row direction, and N-columns of address electrodes D1 through DN are arrayed in column direction.

In the plasma display apparatus having the electrode structure discussed above, when a writing pulse is applied between address electrode 19 and scanning electrode 13, an address discharge is executed therebetween, and a discharging cell is selected. After that, a sustain pulse, which changes plus and minus signals alternatively and periodically, is applied between scanning electrode 13 and sustain electrode 14, so that a sustain discharge is executed therebetween, and a display is shown.

Figure 3:
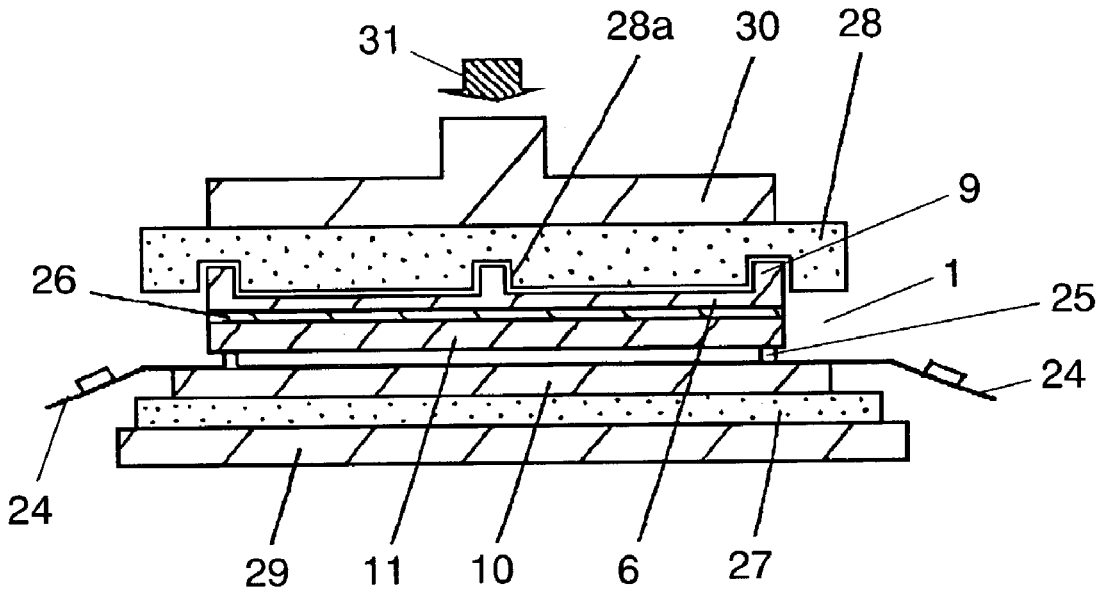
FIG. 3 is a schematic sectional view showing a structure of an apparatus for applying pressure and bonding a panel and a sustaining board in accordance with an exemplary embodiment of the present invention.

FIG. 3 is a schematic sectional view showing a structure of an apparatus for manufacturing the plasma display apparatus in accordance with the embodiment of the present invention. As discussed above, panel 1 is formed of front panel 10 and rear panel 11, and flexible wiring boards 24, which supply voltages to display electrodes 15 and address electrodes 19, are connected with front panel 10 and rear panel 11. Flexible wiring boards 24 connected with front panel 10 are only shown in FIG. 3. The circumference of front panel 10 and rear panel 11 are sealed with sealing compound 25.

A heat conducting adhesive sheet 26 is disposed on a surface of rear panel 11 of panel 1, and chassis 6 used as a sustaining board is disposed on heat conducting sheet 26. Chassis 6 (sustaining board) is made of aluminum and the like, and also functions as a radiating board. Bosses 9 used for attaching a plurality of circuit blocks and the like are produced on a rear surface of chassis (sustaining board) 6. A front surface of front panel 10 comes in contact with panel-side pressuring board 27, and the rear surface of chassis 6, where bosses 9 are formed, comes in contact with sustaining-board-side pressuring board 28. Panel-side pressuring board 27 and sustaining-board-side pressuring board 28 are sandwiched by lower press stand 29 and upper press stand 30. In the condition mentioned above, pressure 31 is applied, so that rear panel 11 of panel 1 and chassis 6 are bonded to each other via heat conducting sheet 26.

Heat conducting sheet 26 is formed of an insulating sheet made of acrylic, urethane, silicon and the like, and has adhesive layers on both sides. Thus, sheet 26 has heat conductivity and elasticity, and transmits heat generated by panel 1 to chassis 6 efficiently. A heat conducting sheet having the same size as panel 1 can be used as heat conducting sheet 26, or a plurality of divided heat conducting sheets can be also used.

Figure 4:
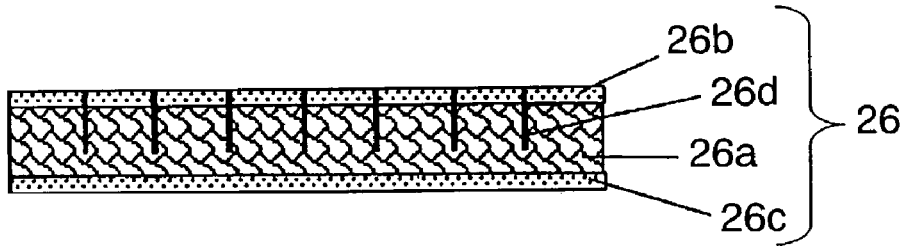
FIG. 4 is a sectional view showing a structure of a heat conducting sheet in accordance with the embodiment of the present invention.

FIG. 4 is an enlarged sectional view of heat conducting sheet 26. Heat conducting sheet 26 is formed of porous insulating sheet 26*a* made of a cellular porous medium such as urethane foam, and has adhesive layers 26*b*, 26*c* on both sides. At a side of adhesive layer 26*b* which adheres to rear panel 11, a plurality of slits 26*d* are formed from a surface of adhesive layers 26*b* to an inside of porous insulating sheet 26*a*. Perforations, which approximately reach the middle of insulating sheet 26*a*, are formed in specific patterns, thereby providing slits 26*d*. During bonding, each slit 26*d* has a function of expelling air bubbles, thus bonding sheet 26 to rear panel 11 uniformly and eliminating air bubbles in sheet 26. As a result, decrease of heat conductivity of heat conducting sheet 26 is prevented.

As shown in FIG. 3, panel-side pressuring board 27 is larger than front panel 10, and sustaining-board-side pressuring board 28 is larger than chassis 6. In addition, pressuring board 27 and pressuring board 28 have elasticity to absorb shock. In the case of applying pressure, uniform pressure can be applied to large areas of panel 10 and chassis 6, because pressuring board 27 and pressuring board 28 are large and have a function of shock absorption (i.e., are resilient). In other words, pressure can be applied without increasing local stress even if panel 1 or chassis 6 is deformed. Insulating sheet 26*a* is made of electrically-conductive material, e.g., urethane material containing carbon material and having approximately $4.8\times10^6$ Ω/cm electric resistance, for removing static electricity generated when applying pressure to panel 1 and chassis 6. Static electricity, which is generated by contact electrification while applying pressure, moves to lower press stand 29 or upper press stand 30, so that circuit elements mounted on flexible wiring boards 24 and the like are prevented from being destroyed.

Figure 5:
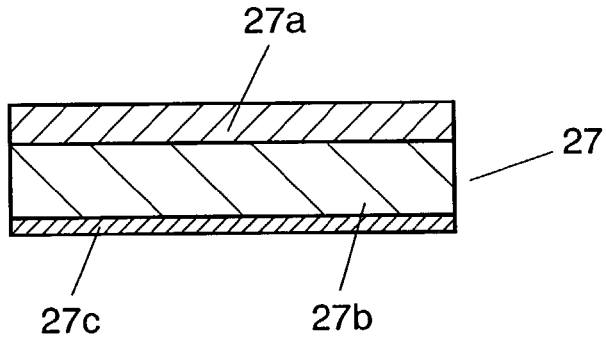
FIG. 5 is a sectional view showing a structure of a panel-side pressuring board in accordance with the embodiment of the present invention.

As shown in FIG. 5, electrically conductive panel-side pressuring board 27 has a three-layered structure formed of first buffer 27*a*, second buffer 27*b* and resin sheet 27*c*. First buffer 27*a* having a large compressive elasticity modulus is formed at the surface which comes into contact with front panel 10, and is used for preventing panel 1, which is made of glass, from being destroyed. Second buffer 27*b* is harder than first buffer 27*a*, and is used for applying pressure uniformly and entirely. Resin sheet 27*c*, which is made of resin material such as polypropylene, is used as a sliding board on lower press stand 29. As a result, the sliding board allows pressing board 27 to be easily taken in and out of lower press stand 29, and electrostatic charge due to friction on stand 29 is prevented.

As shown in FIG. 3, electrically conductive sustaining-board-side pressuring board 28 comes in contact with a surface of chassis 6 where circuit blocks are disposed. However, the surface of chassis 6 where circuit blocks are disposed has a concave-convex shape, because bosses 9 and the like are exist. In order to avoid the concave-convex shape, a surface of pressuring board 28 which faces chassis 6 is molded corresponding to the concave-convex shape of chassis 6, and forms concave-convex shape 28*a*. Pressure 31 is applied from above sustaining-board-side pressuring board 28 using upper press stand 30 so that uniform pressure is applied entirely to panel 1 and chassis 6, which are sandwiched between panel-side pressuring board 27 and sustaining-board-side pressuring board 28.

In this invention, heat conducting sheet 26 bonded on chassis 6 is piled on rear panel 11, and chassis 6 is bonded temporarily to panel 1 via heat conducting sheet 26. Then, while front panel 10 of panel 1 contacts panel-side pressuring board 27, panel 1 and chassis 6 are supported on panel-side pressuring board 27 on lower press stand 29. After that, sustaining-board-side pressuring board 28 is disposed on chassis 6.

Figure 6:
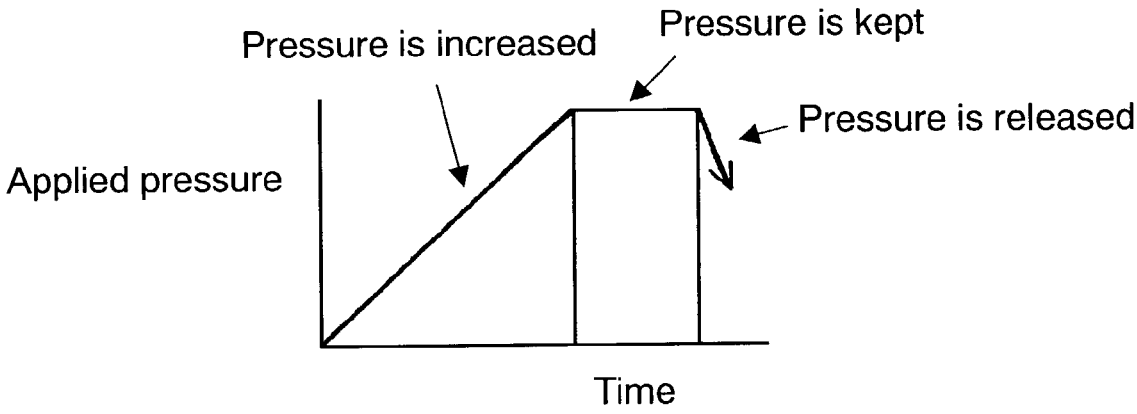
FIG. 6 is a graph showing a relation between time and applied pressure in the case of applying pressure and bonding in accordance with the embodiment of the present invention.

As shown in FIG. 6, upper press stand 30 descends gradually for applying pressure. After the pressure reaches a predetermined value, the pressure is kept at the predetermined value for a predetermined period, and then released. As a result, panel 1 adheres to chassis 6 via heat conducting sheet 26.

Figure 7:
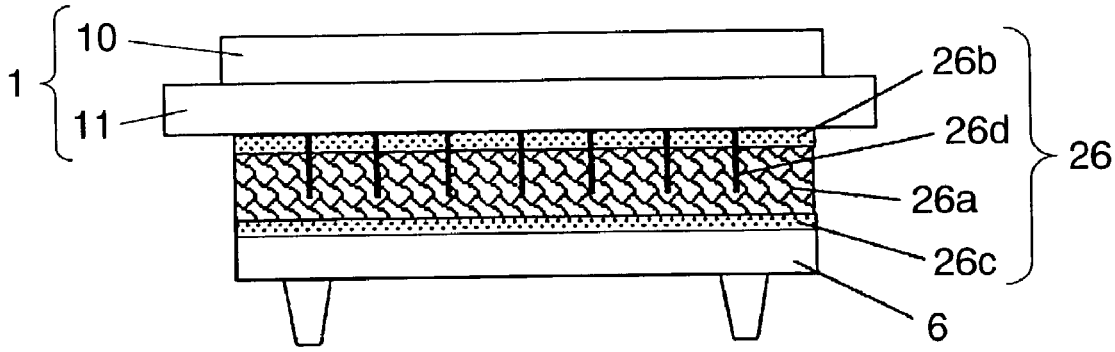
FIG. 7 is a schematic sectional view of a plasma display apparatus in accordance with the embodiment of the present invention.
Figure 8:
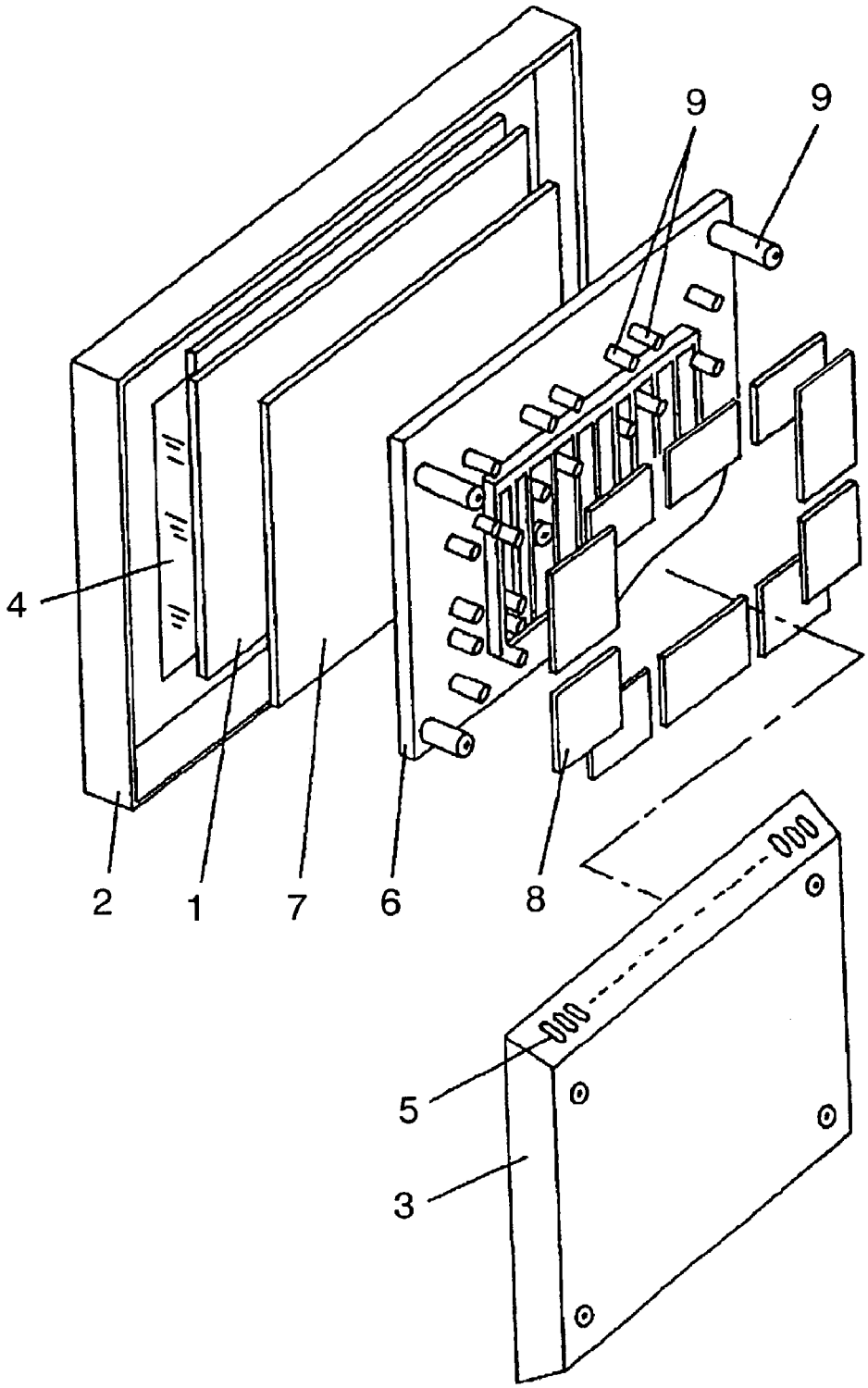
FIG. 8 shows an exploded perspective view of a plasma display apparatus.

FIG. 7 shows the structure of bonding panel 1, which is formed of front panel 10 and rear panel 11, to chassis 6 via heat conducting sheet 26.

In this embodiment, as discussed above, the process of bonding panel 1 to chassis 6 via heat conducting sheet 26 is provided. Panel 1 and chassis 6 are sandwiched between resilient panel-side pressuring board 27, which is larger than panel 1, and resilient sustaining-board-side pressuring board 28, which is larger than chassis 6. After that, a predetermined amount of pressure is applied from above panel-side pressuring board 27 or sustaining-board-side pressuring board 28. As a result, panel 1 can adhere to chassis (sustaining board) 6 via heat conducting sheet 26 without being destroyed, and a sufficient bonding area can be obtained. A conventional bonding area performed by handwork is approximately 5%, but a bonding area of approximately 35% can be obtained using the method of this invention.

In this embodiment, panel 1 is bonded to a front surface of chassis 6 via heat conducting sheet 26, and sustained thereby. As a result, after panel 1 is bonded to chassis 6, panel 1 and chassis 6 are removed from the press apparatus, and circuit blocks 8 can be attached to the rear surface of chassis 6. In other words, because chassis 6 is attached to panel 1, conveyance becomes efficient in an assembling process of attaching circuit blocks 8 to chassis 6. A conveyance between processes largely affects productivity of a plasma display apparatus, because a large display area, e.g. 42 inches, is considered to be a mainstream size of a plasma display apparatus. As discussed above, the efficient and smooth conveyance from the process of attaching panel 1 on chassis 6 to the process of attaching circuit blocks 8 on chassis 6 improves productivity considerably.

INDUSTRIAL APPLICABILITY

In a method for manufacturing a plasma display apparatus of this invention, the plasma display apparatus has a structure for bonding a panel to a sustaining board (chassis) via a heat conducting sheet, and the panel can adhere to the sustaining board by securing a sufficient bonding area. As a result, the plasma display apparatus can efficiently radiate heat from the panel and improve its mechanical strength.

The invention claimed is:

1. A method of manufacturing a plasma display apparatus, comprising:

forming a panel by arranging a pair of glass substrates so as to face each other with a discharging space therebetween, the discharging space having a plurality of discharge cells, a circuit element being mounted to the panel and the panel being connected to a wiring board;

mounting a metal sustaining board to a back side of the panel via an adhesive sheet;

sandwiching the panel having the circuit element mounted thereto and the metal sustaining board between a pair of electrically conductive and resilient pressuring boards while the metal sustaining board is mounted to the back side of the panel via the adhesive sheet, each of the electrically conductive and resilient pressuring boards being larger than the panel and larger than the metal sustaining board; and applying pressure from the electrically conductive and resilient pressuring boards to the panel and the metal sustaining board by pushing at least one of the electrically conductive and resilient pressuring boards toward the other of the electrically conductive and resilient pressuring boards to thereby adhere the metal sustaining board to the panel via the adhesive sheet.

2. The method of claim 1, wherein a first one of the pair of electrically conductive and resilient pressuring boards has a shape corresponding to a shape of the sustaining board.

3. The method of claim 1, wherein a second one of the electrically conductive and resilient pressuring boards is formed by laminating: a first outer buffer layer for contacting the panel; a resin sheet for preventing electrification and for contacting a press stand at a side of the second one of the electrically conductive and resilient pressuring boards opposite the panel; and a second inner buffer layer between the resin sheet and the first outer buffer layer, the second inner buffer layer being harder than the first outer buffer layer.

4. The method of claim 1, wherein said applying pressure comprises gradually applying pressure from the electrically conductive and resilient pressuring boards to the panel and the metal sustaining board until the applied pressure reaches a predetermined value, and then maintaining the predetermined value for a predetermined period of time before releasing.

5. The method of claim 1, further comprising forming the adhesive sheet by:

laminating a porous insulating sheet between two adhesive layers; and forming a plurality of perforations through one of the adhesive layers and into the porous insulating sheet.

6. The method of claim 1, wherein said sandwiching the panel and the metal sustaining board between the pair of electrically conductive and resilient pressuring boards comprises arranging the panel and the metal sustaining board between the pair of electrically conductive and resilient pressuring boards so that the panel is mounted beneath the metal sustaining board.

7. The method of claim 1, wherein the panel and the metal sustaining board are sandwiched between the pair of electrically conductive and resilient pressuring boards so that static electricity generated during said applying pressure is removed from the panel and the metal sustaining board via the electrically conductive and resilient pressuring boards.

* * * * *